US006336450B1

(12) United States Patent
Collet

(10) Patent No.: US 6,336,450 B1
(45) Date of Patent: Jan. 8, 2002

(54) TERRACE HEATING DEVICE

(76) Inventor: Jean Collet, 74410 Saint Jorioz, Chemin de la Tuilerie (FR)

( * ) Notice: Subject to any disclaimer, the term of this patent is extended or adjusted under 35 U.S.C. 154(b) by 0 days.

(21) Appl. No.: 09/446,175

(22) PCT Filed: Jun. 16, 1998

(86) PCT No.: PCT/FR98/01258

§ 371 Date: Apr. 24, 2000

§ 102(e) Date: Apr. 24, 2000

(87) PCT Pub. No.: WO98/58211

PCT Pub. Date: Dec. 23, 1998

(30) Foreign Application Priority Data

Jun. 16, 1997 (FR) ..... 97 07675

(51) Int. Cl.[7] ..... F24C 15/22
(52) U.S. Cl. ..... 126/92 B; 135/16
(58) Field of Search ..... 126/92 AC, 92 B, 126/92 A; 135/16

(56) References Cited

U.S. PATENT DOCUMENTS

| | | | | |
|---|---|---|---|---|
| 3,739,792 A | | 6/1973 | Holland | 135/16 |
| 5,964,233 A | * | 10/1999 | Clark et al. | 135/16 |
| 6,102,031 A | * | 8/2000 | Waters | 126/92 AC |

FOREIGN PATENT DOCUMENTS

| | | | | |
|---|---|---|---|---|
| DE | 2023734 | | 11/1970 | |
| EP | 976979 A1 | * | 2/2000 | |
| FR | 1141557 | * | 9/1957 | 126/92 B |
| IT | 526841 | * | 5/1955 | 126/92 B |
| JP | 09196381 A | * | 7/1997 | |
| JP | 09303784 A | * | 11/1997 | |

* cited by examiner

*Primary Examiner*—Sara Clarke
(74) *Attorney, Agent, or Firm*—Fay, Sharpe, Fagan, Minnich & McKee, LLP

(57) ABSTRACT

A terrace heating device includes a reflector (7) for reflecting rising heat from a heater (8) downward toward patrons on a terrace. An umbrella-like cover (10) is arranged on a support pole above the heater. The umbrella-like cover is articulable between an open position (FIG. 2*b*) and a closed position (FIG. 2*a*). The open position corresponds to a position of use in which the umbrella-like cover traps heat, holding the heat close to the patrons. In use, the umbrella-like cover is opened and the heater turned on to heat the space underneath the umbrella-like cover. The closed position corresponds to a storage position in which the umbrella-like cover folds about the support pole and a safety switch turns off the heater automatically. The umbrella-like cover is preferably defined by a detachable material for the cover which material is selected in accordance with the season, e.g., insulated for winter.

11 Claims, 14 Drawing Sheets

TERRACE HEATING DEVICE

BACKGROUND OF THE DISCLOSURE

The present invention concerns a terrace heating device. It finds particular application on commercial terraces for restaurants or bars or on private type terraces in such manner to permit utilization of said terraces, regardless of outside temperature, for example, during the winter.

Heating devices equipped with heating elements using propane gas as fuel, with which terraces might be equipped during the cold seasons, are known in the art. The heating elements are generally located up high in such manner so as to radiate heat towards the ground. However, these apparatuses have numerous drawbacks related to their utilization and specifically to the loss of heat. The restaurant owner, the cafe-owner or the user typically provides a large number of these apparatuses on his terrace in order to obtain an adequate temperature.

Moreover, these apparatuses heat the air by radiation. Since hot air has the tendency to rise, such a system does not permit that a satisfactory temperature be obtained, specifically at the level of the lower extremities (feet, legs) which, since they are located beneath a table, will not benefit from the radiation. The loss of heat generated with the different heating apparatuses currently on the market causes high consumption in fuel, such as, for example, propane, particularly when one wishes to maintain an elevated temperature.

Thus, the present invention proposes to solve the various aforementioned drawbacks through the use of a simple, safe and effective means.

SUMMARY OF THE INVENTION

According to the invention, a heating device intended to heat a space, such as a terrace, includes a heating means comprising at least one heating element arranged on or supported by a support pole. An insulation material avoids the loss of heat. Said insulation material is articulable between two positions, an open position deployed in accordance with its on-position, and a closed position in accordance with its off-position.

According to a complementary characteristic, the insulation material forms a large-scale cupola and, when in an open position, is in an approximately horizontal plane located above the heating element.

According to another complementary characteristic, the cupola insulation material is comprised of a fabric, or comprises a group of rigid or semi-rigid elements, such elements being arranged and articulated on the support pole or on an additional integral part of the pole.

It should be added that the cupola can be deployed in an open position, for utilization, or can be folded in a closed position due to an actuation and positioning mechanism. Also, the heat reflection of the heating element is provided by at least one reflective cupola.

According to another characteristic of the terrace heating device, the reflection of heat is also accomplished by an insulation material, for example, by a fabric.

According to a variation in embodiment, the support pole is placed in such manner so as to be located on the perimeter of the space, arranged in plumb alignment relative to the heating means and the insulation means. It is clear that the insulation aids in reducing the radiation dispersion and/or of the heat that might escape into the atmosphere. However, when it is desired to place the device in the off-position, it can easily be moved for storage. When the device is on, the large dimension of the cupola provides excellent conservation of hot air volume, assuring perfect user comfort with a minimum of consumed energy.

BRIEF DESCRIPTION OF THE DRAWING

Additional characteristics and benefits of the invention are apparent from the description given below in regard to the attached drawings, which are provided by way of example only and are not limited thereto.

FIGS. 1 to 7 illustrate the different specific embodiments of the terrace heating device and their variations.

FIG. 1 illustrates a first embodiment of the terrace heating device seen in exterior frontal view.

FIG. 7 illustrates in a view similar to FIG. 2*a*, a variation of the different embodiments of the terrace heating device.

FIGS. 8*a* and 8*b* are views similar to FIGS. 2*a* and 2*b*.

FIGS. 9*a* and 9*b* are top views corresponding, respectively, to the positions of FIGS. 8*a* and 8*b*.

FIGS. 10*a* and 10*b* illustrate a first variation according to views similar to FIGS. 8*a* and 8*b* respectively.

FIGS. 11*a* and 11*b* represent a second embodiment variation according to views similar to FIGS. 8*a* and 8*b*.

FIGS. 12*a* to 15 illustrate different specific embodiments of the heating device comprising a displaced pole.

FIG. 12*a* represents a perspective view of a first specific embodiment of the device in a closed position.

FIG. 15 represents, in a transverse section, the support system of the insulation, of said second specific embodiment.

DETAILED DESCRIPTION OF THE PREFERRED EMBODIMENTS

Figure 1:
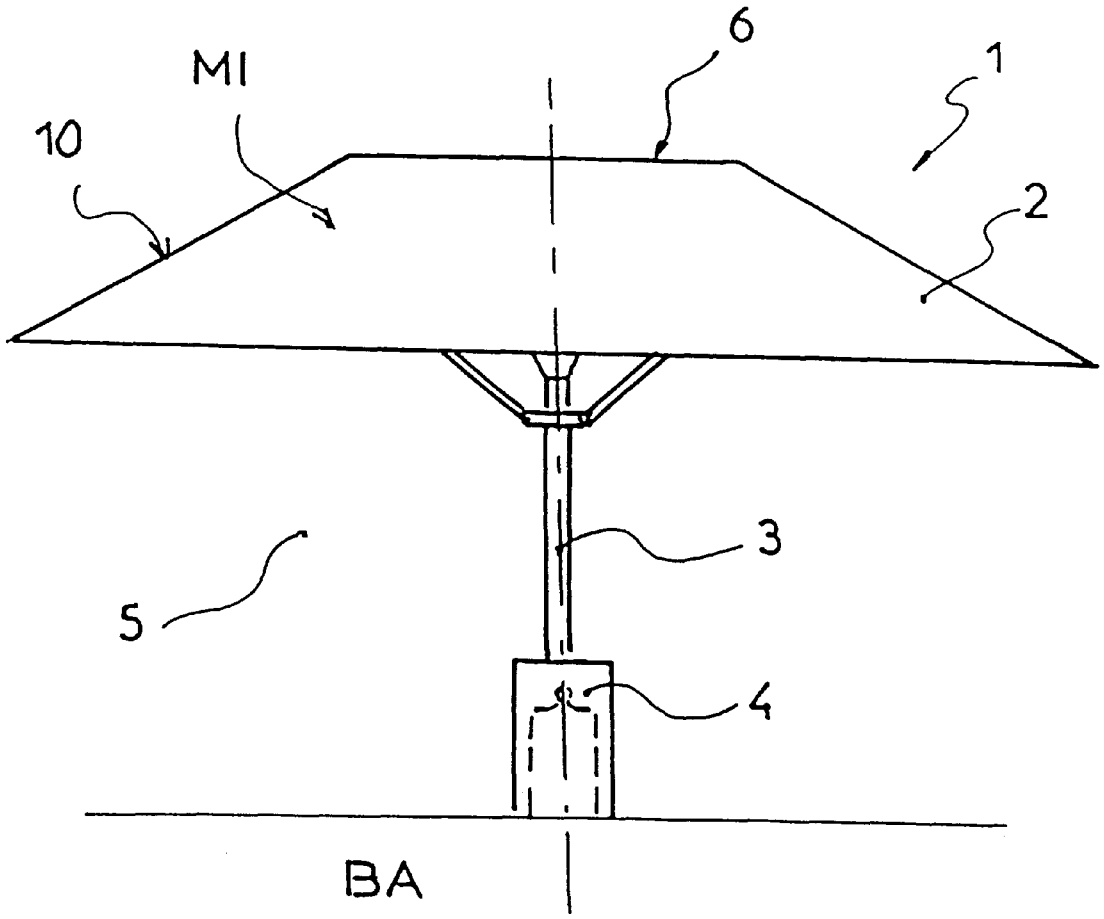

With reference to the FIGURES, a terrace heating device, identified by general reference 1 comprises the heating means MC, composed of at least one heating element 8. Said heating element can be of the radiant type heat, fueled by a gas supply MA, which can be, for example, propane or butane. The heating element 8 can likewise be of any type such as for example, electric or operating with diesel oil, with the fuel supply means MA beneficially corresponding to the employed type of heating element. Said heating element 8 is attached to a support pole 3 in a manner so as to beneficially permit said heating element to be located at a height L from the ground, ranging between 1 and 3 meters. The radiation of the element and/or, the heat furnished by the combustion can be beneficially oriented or directed towards the ground in order to directly heat the space 5 located vertically relative to said heating element 8. It should be noted that the heating element 8 is beneficially located at the top of the support pole 3.

The heating means MC includes a means of reflection MR of radiation emission produced by the heating element 8. According to several specific embodiments described herein, the means of reflection includes a reflecting cupola 7 in a form of a crown oriented towards the bottom EA which is arranged above the heating element 8 in order to reflect the radiation of the element towards the space 5. Furthermore, the heating device 1 according to the invention comprises an insulation material MI intended to reduce the loss of heat, which is produced in the space 5 situated between the ground and the heating element.

Figure 2A:
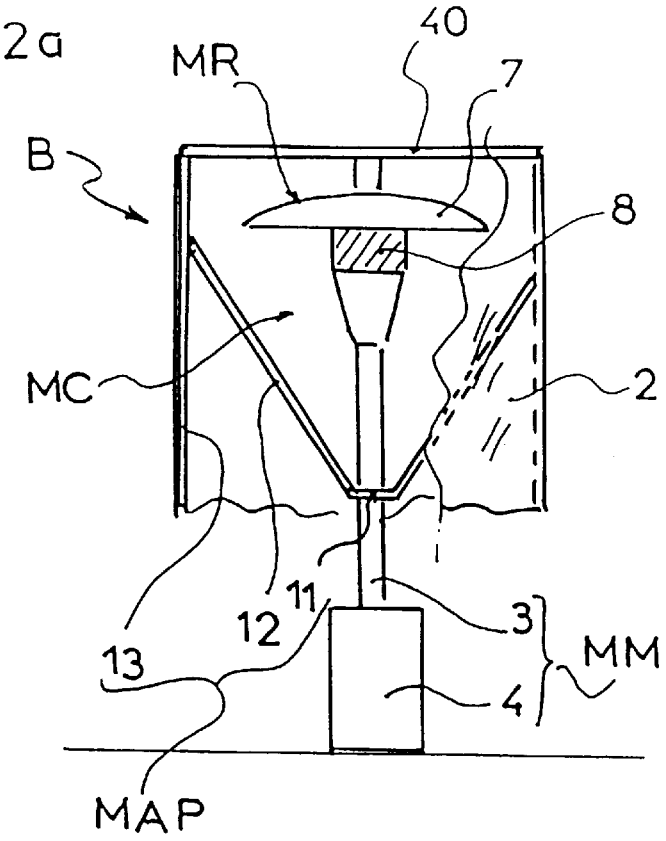
FIG. 2*a* illustrates the first embodiment of the terrace heating device sectioned in a vertical plane, with insulation material being in a closed position.
Figure 2B:
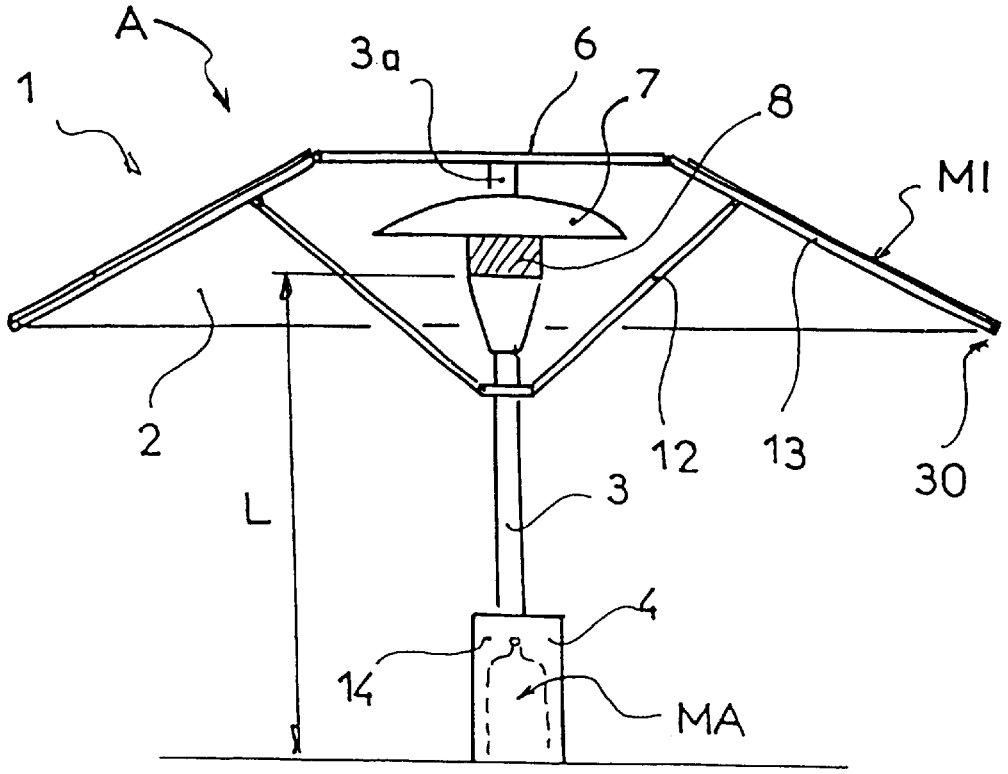
FIG. 2*b* represents in a view similar to FIG. 2*a*,the first embodiment of the terrace heating device, with the insulation material in an open position.

According to a first specific embodiment of the terrace heating device 1, illustrated in FIGS. 1, 2*a* and 2*b*, the insulation material MI includes a fabric 2, which forms panels of an umbrella-like cover. The fabric can be deployed in a position called an open position A, where the fabric 2 is arranged above the heating element 8, as illustrated in FIGS. 1 and 2*b*. Alternatively, it can be folded in a closed, or off-position B, as depicted in FIG. 2*a*. The deployment, and storing of the fabric 2 is performed by an actuating and positioning means MAP, which permits, on the one hand, articulation of the fabric from its open position A, to its closed position B. Conversely, the use of the device involves positioning and bracing, to shape the fabric 2, when it is deployed in open position A.

The fabric 2, and the actuating and positioning means MAP are supported by at least one support pole 3 mounted on a base 4, said base being intended to be installed on a terrace. Consequently, the terrace heating device 1 is intended to be installed in a fixed manner, in order to define between the ground and the insulation material MI a heated space 5 whose heating surface ranges between 10 $m^2$ and 30 $m^2$.

According to said first specific embodiment, the support pole 3, comprising the holding means MM is arranged on a vertical axis XX' plumb with the central zone 6 of the fabric 2. Said support pole is intended to support the heating element 8, the cupola 7, the fabric 2, and the actuating and positioning means MAP of said fabric.

According to said first specific embodiment, the fabric 2 has a beneficial round shape and comprises a central zone 6, arranged approximately at the top 3*a* of the support pole 3 on a rigid support 40, and further supporting a portion of the peripheral fabric 10. Said central zone 6 also having a circular shape in said specific embodiment is arranged in a horizontal plane and has larger dimensions than the dimensions of the cupola 7 which it overhangs. The portion of the peripheral fabric 10 extends, towards the outside, of the central zone 6 of the fabric, said portion being able to be deployed or folded under the influence of the actuating and positioning means MAP. The diameter of the fabric 2, in the open position, beneficially ranges between 1.2 m and 5 m in order to insulate underneath a space 5 with sufficient dimensions in order to permit accommodation of several persons.

According to said specific embodiment, the actuating and positioning means MAP includes a sliding ring or runner 11, arranged in sliding fashion on the support pole 3 and equipped with a group of articulated counter-stays or stretchers 12, said counter-stays articulating another set of stays or ribs 13 arranged radially under the portion of the peripheral fabric 10. Said ribs 13 are articulated in relationship to the support pole 3 just below the outside edge of the central zone 6 of the fabric 2 on the rigid support 40 and are fixed at their approximately opposite extremity to the outside edge 30 of the portion of the peripheral fabric 10 in order to be able to tighten same when it is in an open position A as depicted in FIGS. 2*a* and 2*b*. It is self-understood that the central part 6 of the fabric 2 could be in the shape of a cap or a crown, whose external edges would be arranged in a fixed manner about a horizontal plane located above the reflecting cupola.

It should be noted that the heating element 8 is supplied by a fuel means MA corresponding to the type of heating element such as, for example, bottled gas, said supply means MA being beneficially arranged in an enclosure 14 of base 4 of the heating device 1. In addition, said base comprises displacement means MD such as wheels, intended to permit displacement of the device 1. It should be noted that according to the preferred specific embodiments of the terrace heating device 1 the heating element 8 is a radiant heating element utilizing propane gas.

Figure 3A:
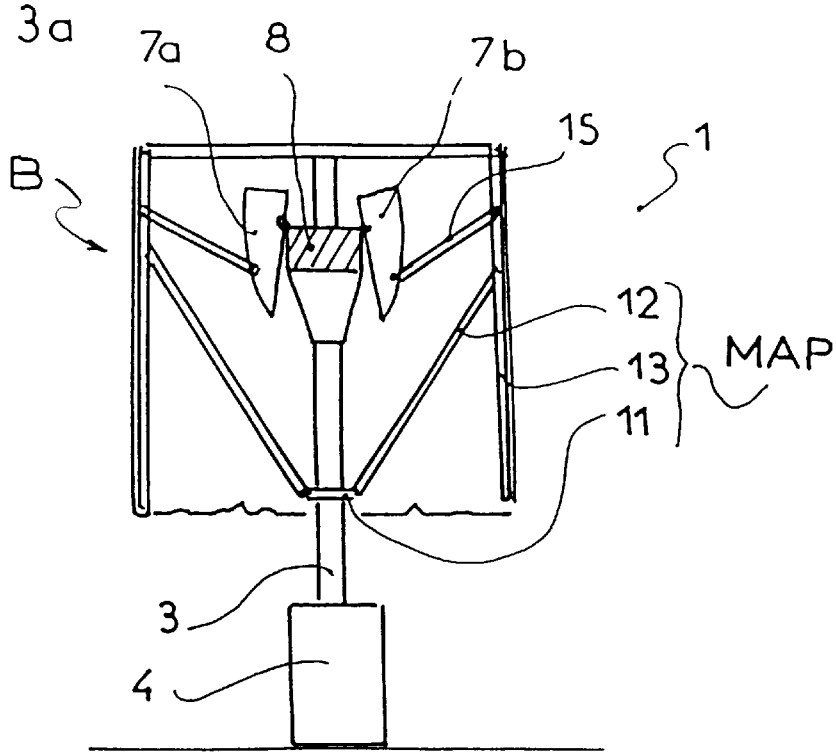
FIG. 3*a* illustrates a variation of the first embodiment in a view similar to FIG. 2*a*.
Figure 3B:
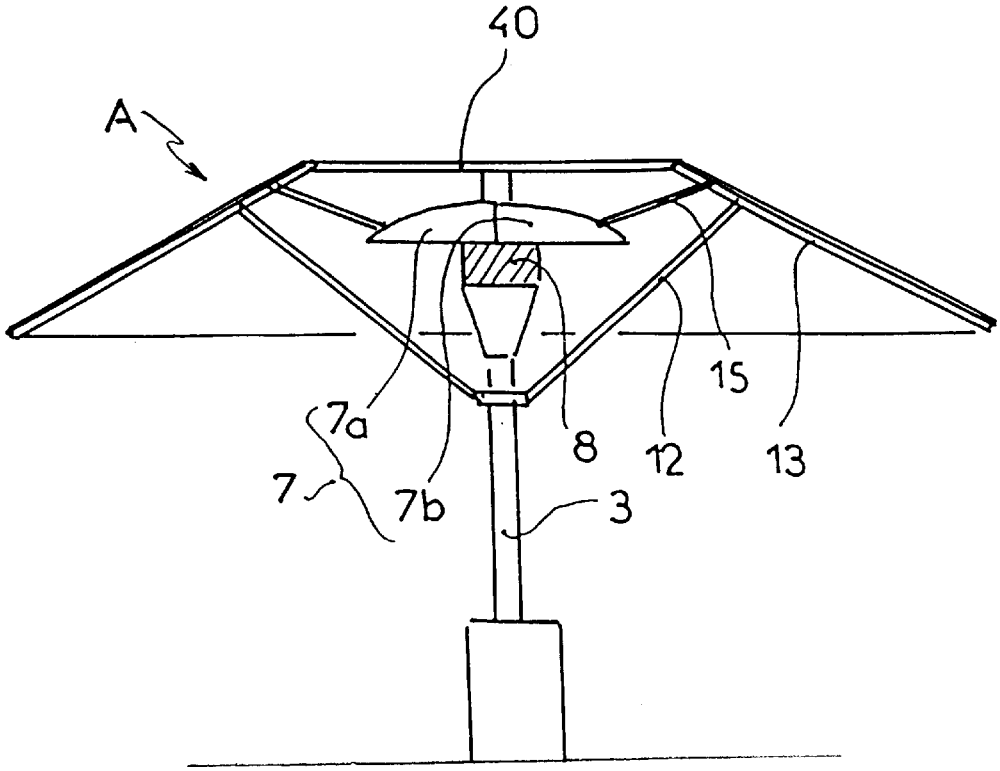
FIG. 3*b* illustrates said variation in an open position, in a view similar to FIG. 2*a*.

According to a variation of said first specific embodiment illustrated in FIGS. 3*a* and 3*b*, the terrace heating device is of the type previously described with a central support pole 3, equipped with the heating element 8, a reflecting cupola 7, and fabric 2. According to said variation, the reflecting cupola 7 arranged beneath the fabric 2 comprises at least two parts of the cupola 7*a*, 7*b*, mobile relative to the support pole 3 between a folded position B, where said parts are arranged vertically around the heating element, and an open position A where said parts are assembled in such manner so as to form the reflecting cupola 7, which is beneficially slightly above the heating element 8.

According to said variation, the articulation of the parts of the cupola 7*a*, 7*b* are effected under the influence of actuating and positioning means MAP, similar to that of the fabric 2, in a beneficially simultaneous fashion. Thus, the folded position of said parts correspond to the closed position B of the fabric, and the open position A of said parts correspond to that of the open position A of the fabric. In order to accomplish that, said parts 7*a*, 7*b*, are articulated on the support pole 3 or on the heating element 8 at the level of their upper extremity and are actuated by a system of complementary counter-stays or stretchers 15, being integral with said portions of the cupola, and articulated on the stays 13. It should be noted that according to said variation the parts of the cupola 7*a*, 7*b*, comprise the means for protection of the fabric 2, and more precisely, the portion of the peripheral fabric 10 so that same will not become scorched when it passes from its open position to its closed or folded position. To that end, the parts of the cupola can have an upper surface equipped with a layer of thermal insulation material.

Figure 4A:
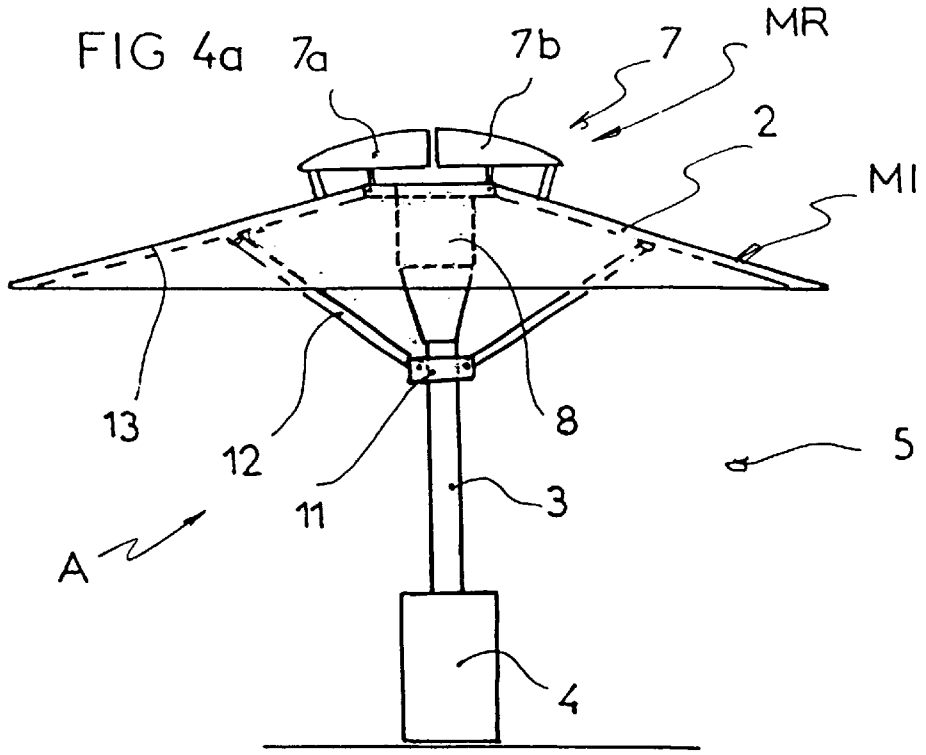
FIG. 4*a* illustrates another embodiment variation in a view similar to FIG. 3*b*.
Figure 4B:
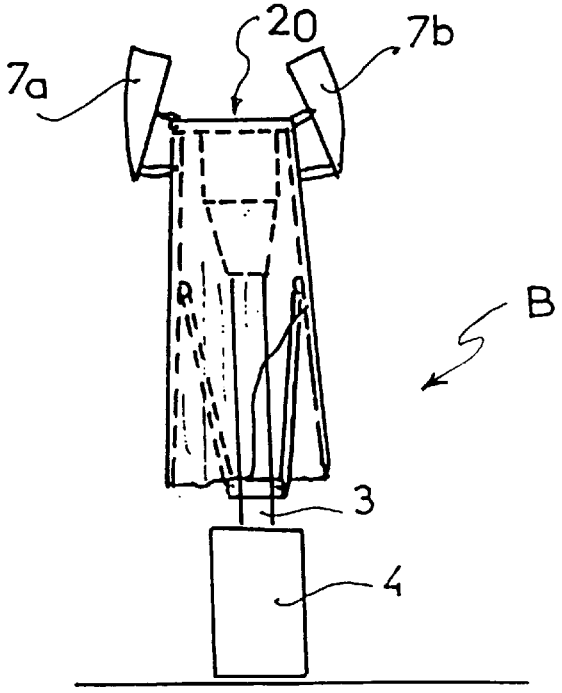
FIG. 4*b* represents said other variation, with the cupola in the open position, in a view similar to FIG. 3*a*.
Figure 4C:
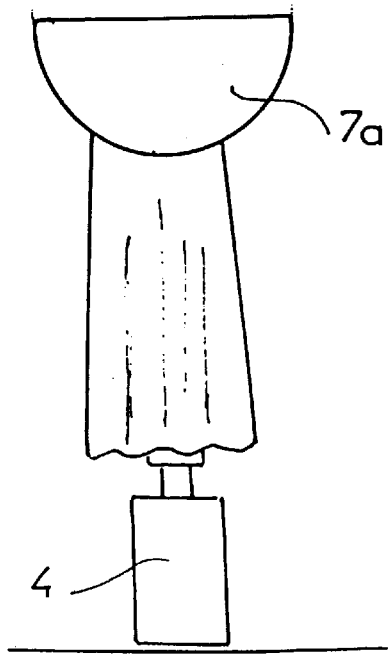
FIG. 4*c* represents said other variation in a lateral view, with the insulation in a closed position.

According to another variation illustrated in FIGS. 4*a,* 4*b* and 4*c,* the device is of the type previously described, while the cupola 7, formed by at least two mobile parts of the cupola 7*a,* 7*b,* is arranged in such manner so as to articulate above the insulation material MI comprising the fabric 2. It should be noted that the parts of the cupola are integral with the stays 13, and rotate in such manner as to articulate to the open position when the actuating and positioning means MAP deploy the fabric 2 as indicated in FIG. 4*a.* According to said variation, the fabric 2 comprises a central opening 20 in plumb alignment with the cupola 7.

It is self-understood that the cupola can be comprised of more than two parts, without going outside the protected field of the invention. Likewise, the articulation of said parts can be effected in a different manner for example by partial super-position.

Figure 5A:
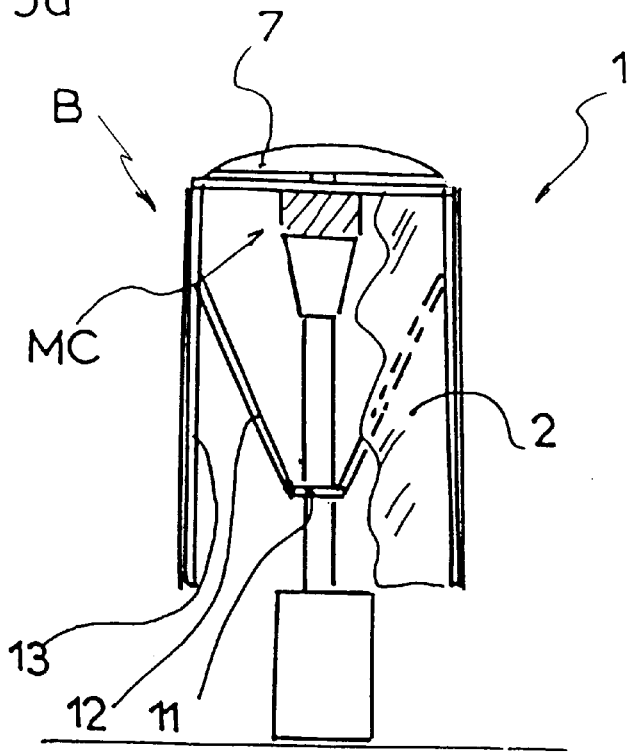
FIG. 5*a* illustrates in a closed position a second specific embodiment of the terrace heating device sectioned in a vertical plane.
Figure 5B:
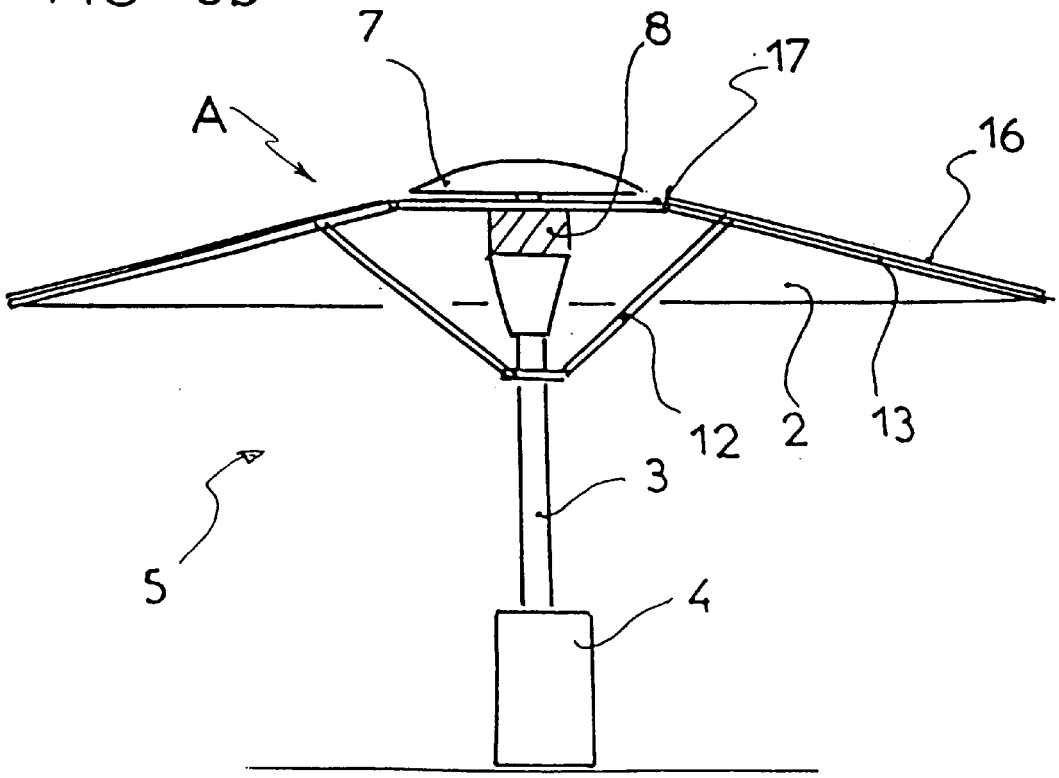
FIG. 5*b* illustrates said second specific embodiment in an open position, sectioned in a vertical plane.

According to a second specific embodiment illustrated in FIGS. 5*a* and 5*b,* the terrace heating device 1 comprises a base 4 on which the support pole 3 is mounted, arranged centrally underneath the fabric 2 which includes the insulation material MI and supporting in its upper part the heating element 8 and the reflecting cupola 7. The fabric 2 is comprised of a portion of the round fabric intended to be attached directly on the external peripheral edge 17 of the cupola 7. The fabric is intended to be tightened by the actuating and positioning means MAP, which comprises a group of stays or ribs 13 arranged below the fabric, articulated on the external peripheral edge 17 of the cupola 7, while the edge of the round fabric portion 16 is attached at the opposite end. The stays 13 are controlled by a device of counter-stays or stretchers 12, articulated by a sliding ring or runner 11, of the type utilized in the first specific embodiment, mounted in sliding fashion on the support pole 3, for example between the cupola 7 and the heating element.

Figure 6A:
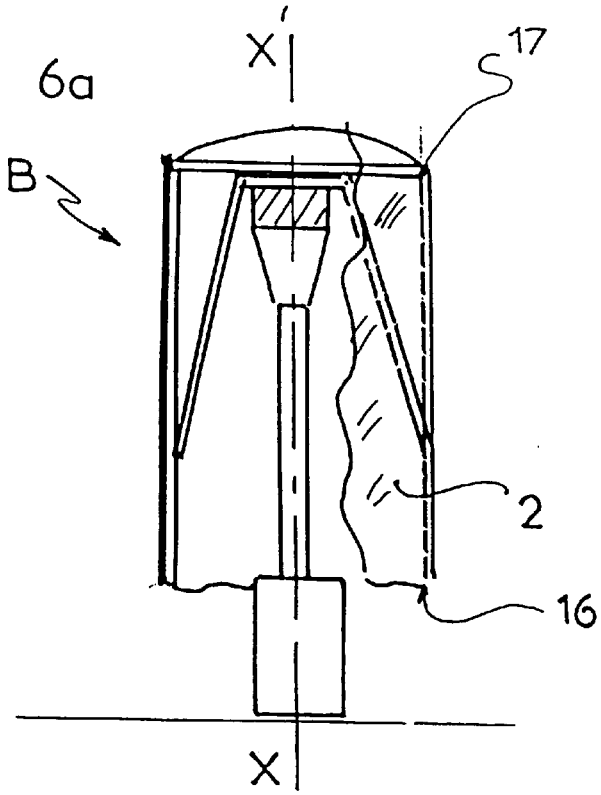
FIGS. 6*a* and 6*b* illustrate, sectioned in vertical plane, a variation of the second specific embodiment of the terrace heating device, in closed and open positions respectively.
Figure 6B:
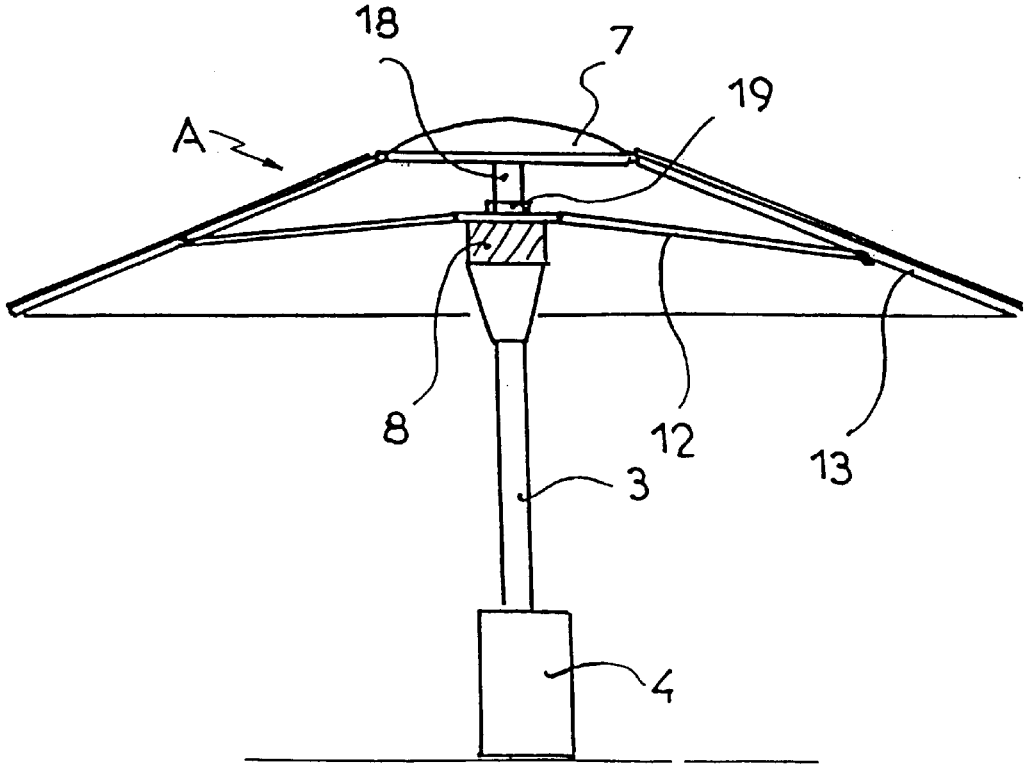

It should be noted that according to a variation of said second specific embodiment illustrated in FIGS. 6*a* and 6*b,* the counter-stays 12 are articulated directly on the support pole 3 at the upper end of the heating element 8, while the cupola 7 is longitudinally mobile along the vertical axis XX' of said support pole, said cupola being mounted on a part of a tube 18 intended to slide on the inside of a tube 19, comprising at least the upper part of the support pole 3, with control means being provided in a manner so as to cause the articulation of the cupola 7 and thus the opening or the closing of the stays and the fabric.

Figure 7:
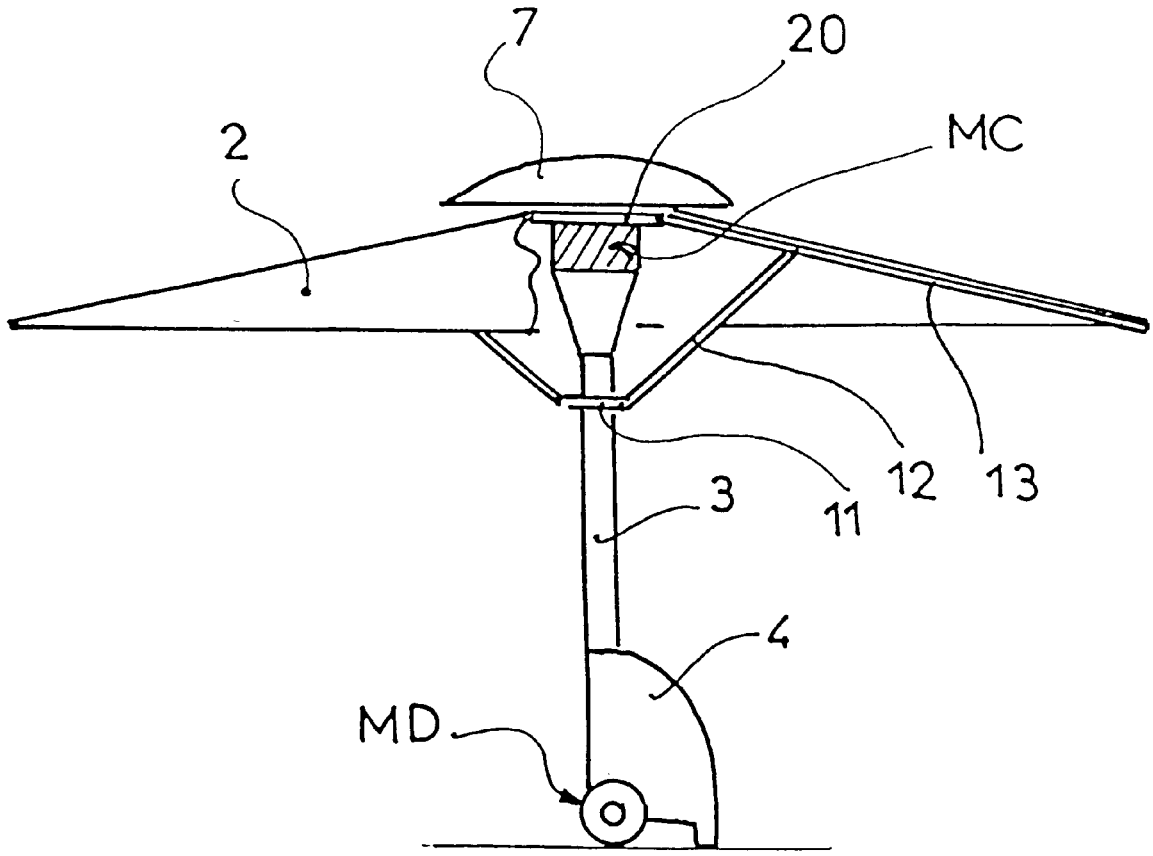

According to a variation of the different specific embodiments illustrated in FIG. 7, the reflecting cupola 7 can be located approximately at the end of the central support pole 3, slightly above the level where the fabric 2 is supported by the stays 13, the fabric 2 having a round central opening 20 in plumb alignment with the cupola 7.

According to a third specific embodiment not shown, the terrace heating device does not have a reflecting cupola, but the reflection means is comprised of the fabric itself, the inside surface of which is directed towards the ground when deployed. It is made of a reflecting material in order to maximally utilize the radiation of the radiant heating element, which is arranged slightly below the fabric in order to heat the air located in the space. According to said specific embodiment, the utilized fabric can, for example, be an aluminum-coated fabric which thus permits maximum reduction of energy loss by reflecting the major portion of the radiation, which it receives, towards the space 5 located underneath.

It should be noted that according to the specific embodiments of the terrace heating device, the attachment means of the fabric 2 at the end of the stays 13, or on a piece which is an integral part of the support pole 3, can beneficially be detachable in such manner so as to be able to remove said fabric 2. Because of that, the heating device 1 can include several interchangeable fabrics, and specifically, a transparent fabric intended to prevent the hot air from escaping from the space 5 where the users are located, and additionally, allowing the rays of the sun to pass through in order to permit said users to become suntanned or to profit from the solar light. It can likewise include a non-transparent fabric 2 in order to be used also, as a traditional type of sun umbrella in the summer in order to create a zone of shade when the apparatus is turned off.

In addition, regardless of the specific embodiment of the heating device, it beneficially includes a control device for ignition, or extinction of the heating device. Likewise, it can beneficially include means for controlling the heating element, to permit control of the radiation intensity that it produces and thus of the temperature prevailing in the space 5. It should be noted that the control device beneficially includes a safety system, so as to permit automatic shut-off, of the heating means when the fabric leaves its open position. Thus, when the fabric 2 is folded, the heating element 8 is automatically shut-off, in order to specifically prevent any risk of damage to said fabric by scorching upon contact with said element. According to the first specific embodiment, for example, the safety system can be comprised of a switch which forms an integral part of the sliding ring 11, and is intended to shut-off the supply to the radiant heating element 8 as soon as the sliding ring 11 moves to close up the fabric.

It should also be noted that the safety system beneficially includes a thermo-couple type sensor, which aids in turning off the supply to the radiant heating element in case of difficulty. It also includes an atmosphere by-pass control for the detection of different problems with the radiant heating element related to poor gas combustion, and specifically for preventing the release of any carbon monoxide, caused by incomplete combustion of hydrocarbons.

The specific embodiments and the variations of the terrace heating device previously described comprise all insulation material MI including a fabric 2 intended to take on a somewhat conical shape, wide open toward the ground or having the shape of a hat, said fabric 2 being round. However, it is self-understood that the terrace heating devices could also include a fabric destined to take on a different shape. Thus, the fabric could be rectangular so as to take on the shape of a pyramid, without going outside the protected field of the invention. It should be noted, however, that the heated surface defined by the fabric beneficially comprises between 10 $m^2$ and 30 $m^2$, regardless of the chosen shape of the fabric. It is, however, possible to increase the heated area by utilizing several heating elements dispersed under the fabric of the insulation means, said fabric could have a larger dimension, for example on the order of 7–8 meters or more.

It should also be noted that the insulation material MI can be comprised of materials other than a fabric, such as, one or several rigid or semi-rigid elements intended to form an insulation surface above the heating element.

We have previously seen that the insulation material MI forms a cupola, which is movable between two positions, an open deployed position A corresponding to the utilization position, and a closed position or stored position B, according to which the cupola is folded for being more or less vertically retracted alongside the support pole 3.

Figure 8A:
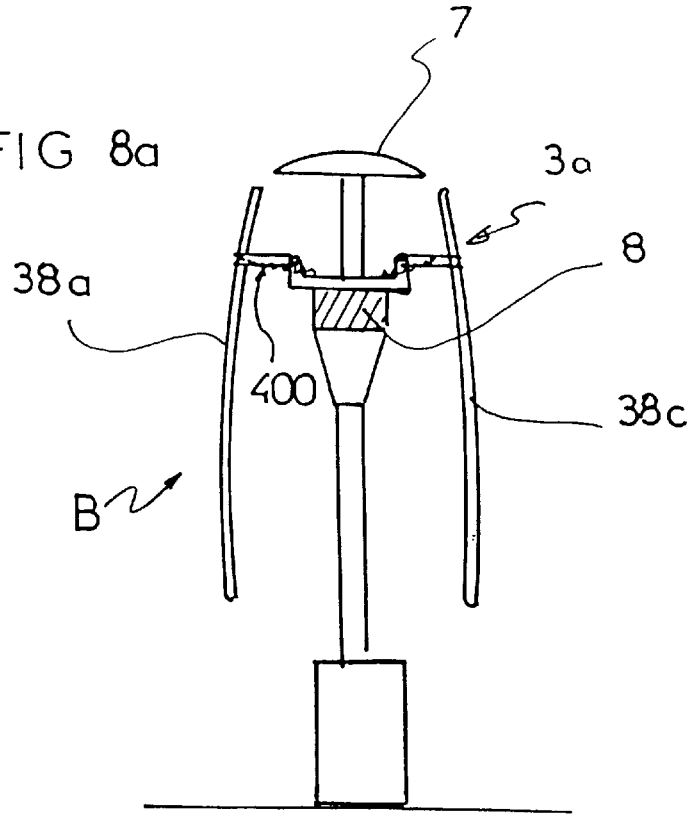
FIGS. 8*a*, 8*b*, 9*a*, 9*b* illustrate a preferred variation of the heating device.

FIGS. 8*a,* 8*b,* 9*a,* 9*b* illustrate a preferred specific embodiment of the invention according to which the largescale cupola 38, comprising the insulation material MI, is made up of several rigid elements 38*a,* 38*b,* 38*c,* 38*d,* having the shape of cupola sections. Each of the sections is arranged so as to be articulable on the support pole, or on a complementary piece forming an integral part of the support pole.

Figure 8B:
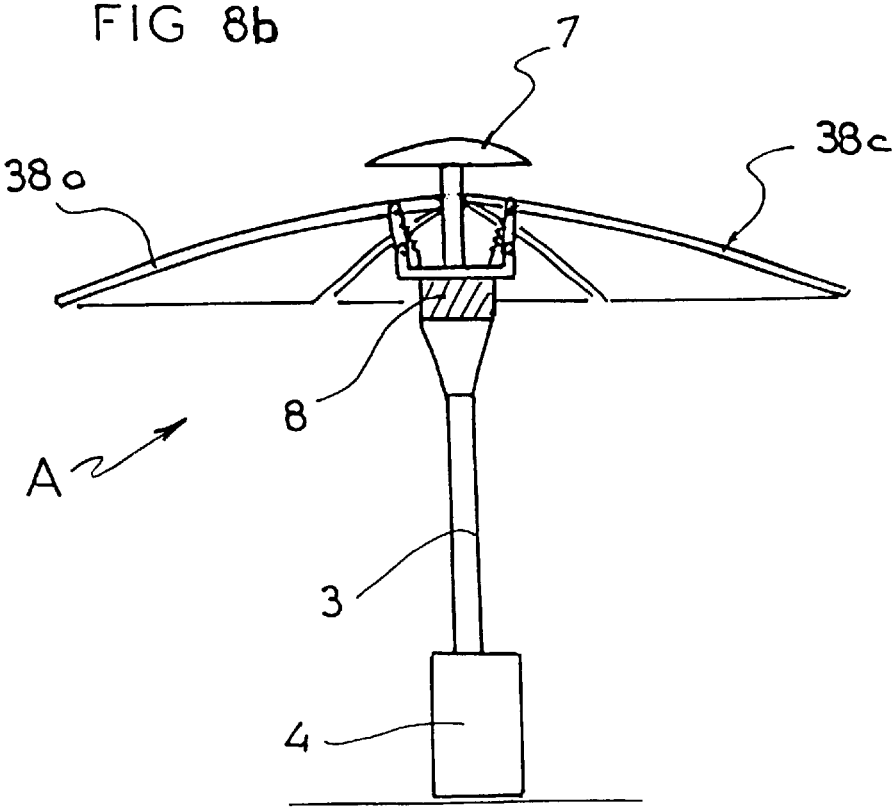
Figure 10A:
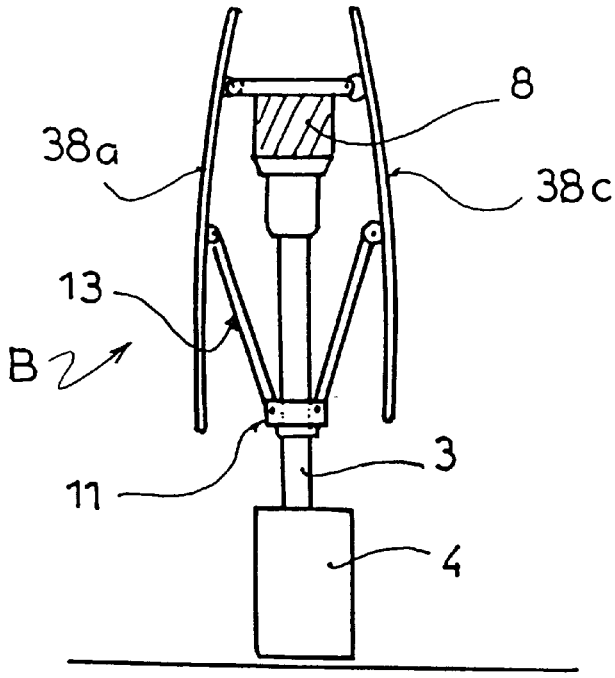
FIGS. 10*a*, 10*b*, 11*a* and 11*b* illustrate two other execution variations.
Figure 10B:
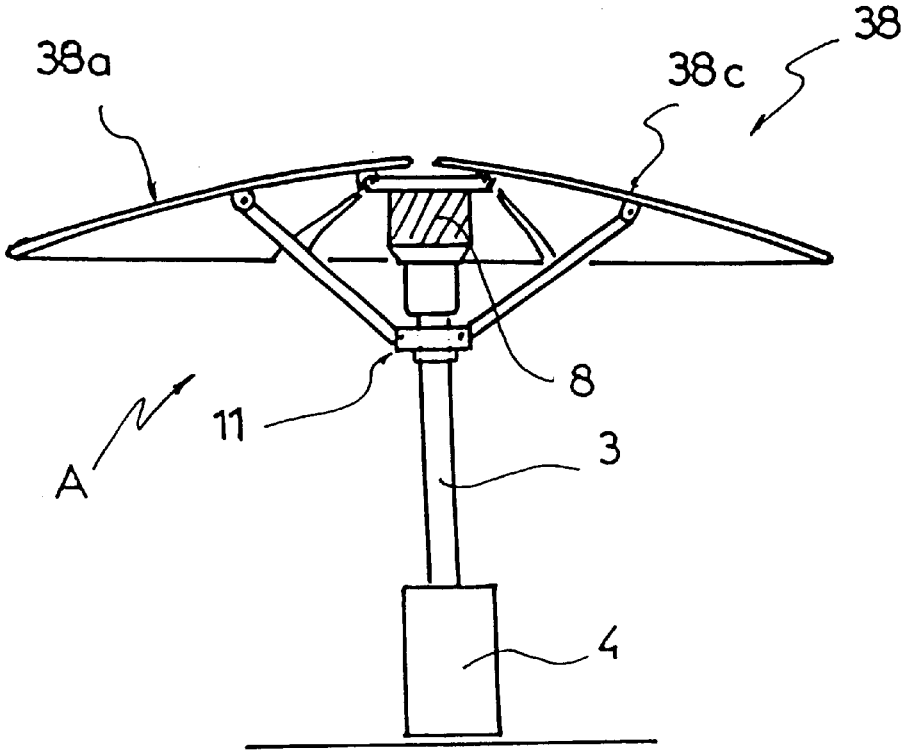

It should be noted that the articulation of each of the sections includes a system of knuckle-joints, comprising a spring 400 permitting the group of sections to have two positions, i.e. the closed, folded position B, and the open position of utilization A. Said spring 400 comprises the actuating and positioning means MAP as indicated in FIGS. 8*a* and 8*b*. It should be noted that according to a variation illustrated in FIGS. 10*a* and 10*b,* the actuating and positioning means MAP could comprise a device which includes a sliding ring 11, counter-stays or stretchers 12, and counter-stays or ribs 13.

Figure 9A:
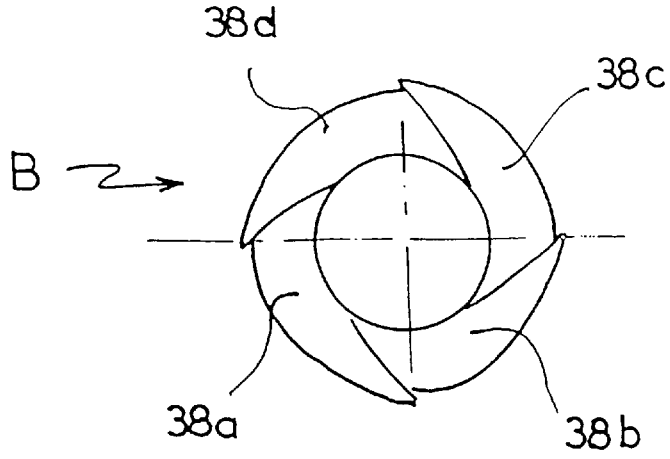
Figure 9B:
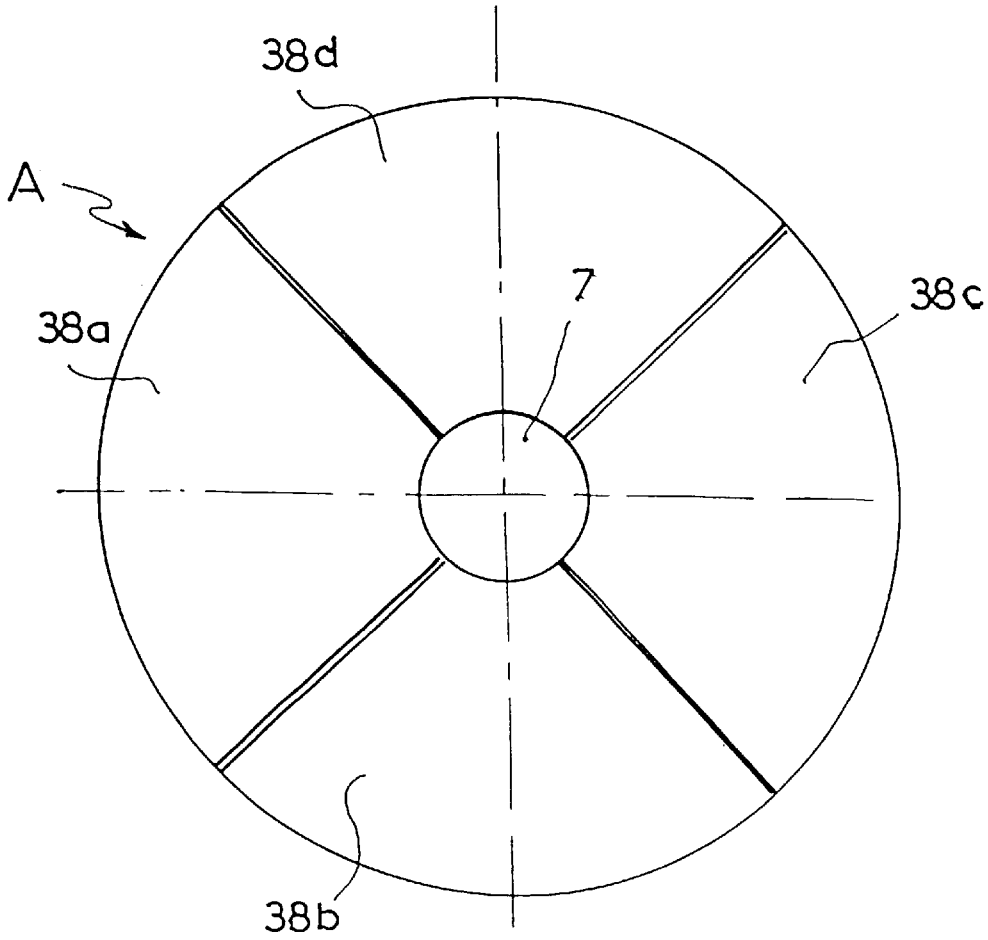

It should be noted that the deployment of elements 38*a,* 38*b,* 38*c,* 38*d,* is effected by opening up like a flower, said elements joining each other at their lateral edges, or partially overlapping each other in order to obtain a solid insulation surface as illustrated in FIG. 9*b*. According to this specific embodiment, the large-scale cupola 38 comprising the insulation material, can likewise include the reflection means by having an internal surface composed of reflecting material directed toward the ground.

Figure 11A:
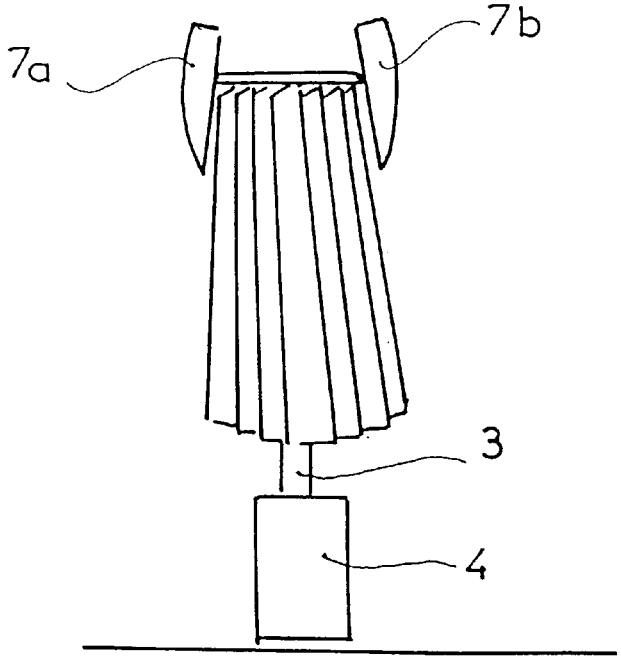
Figure 11B:
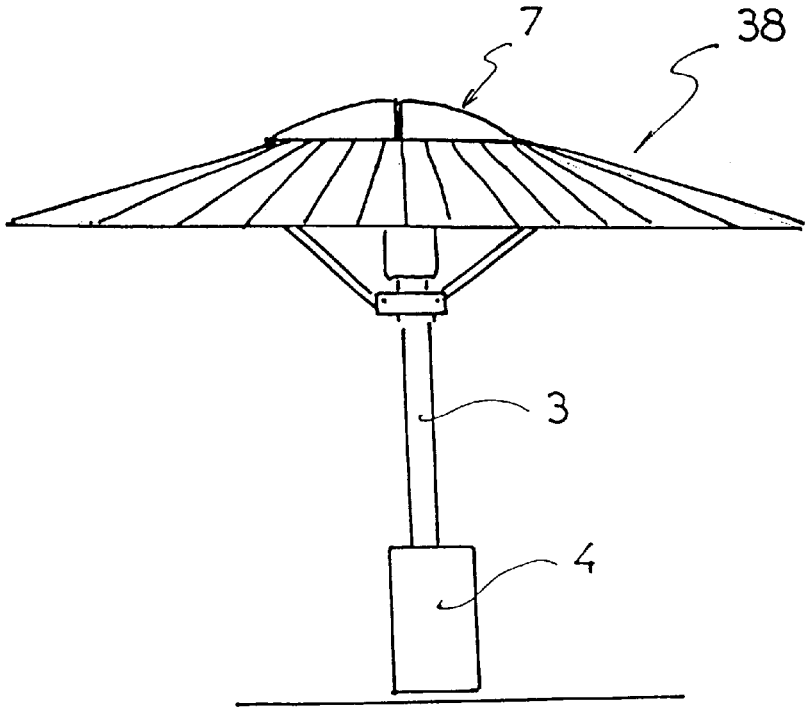
Figure 12A:
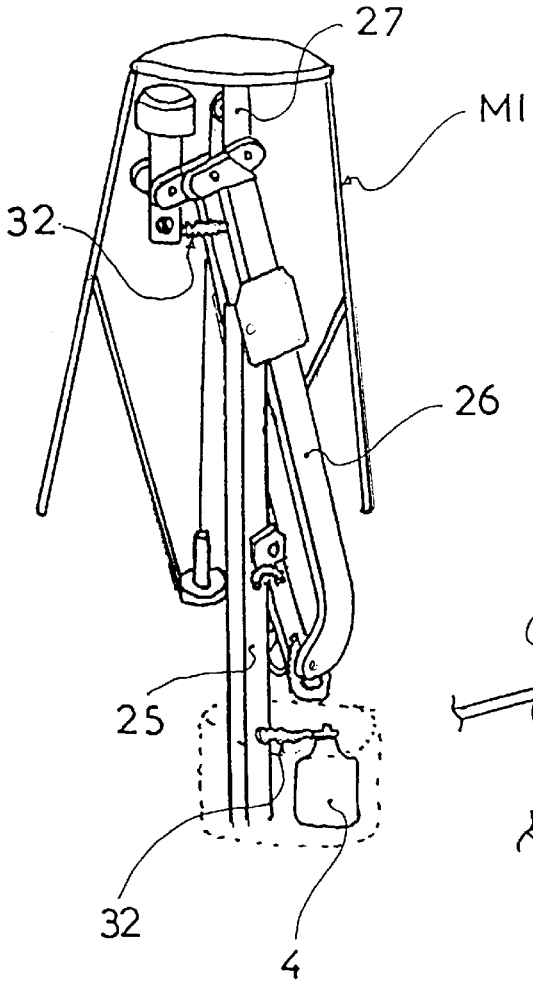
Figure 12B:
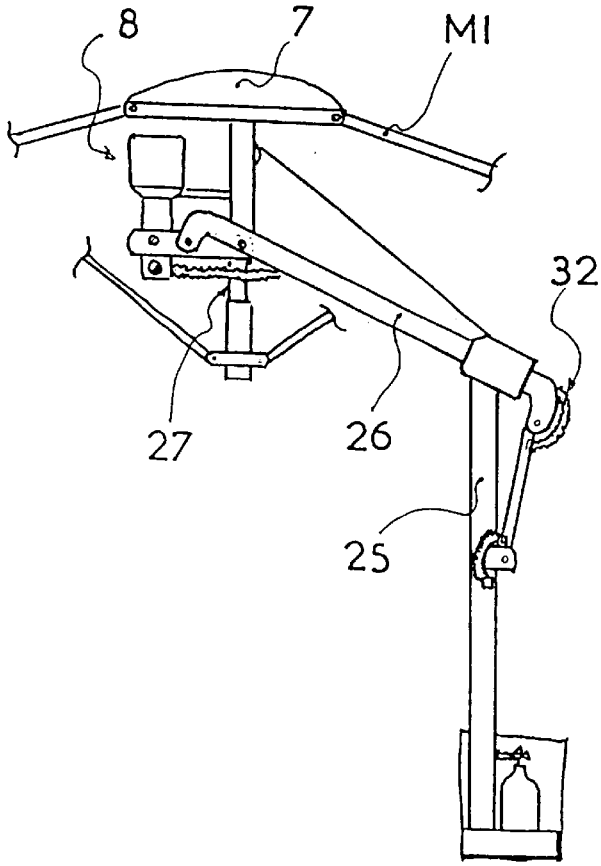
FIG. 12*b* represents said specific embodiment in an open position, sectioned in a transverse vertical plane.

According to this specific embodiment, the insulation surface of the large-scale cupola 38 has a round shape, its diameter beneficially ranging between 1 and 5 meters. In said embodiment, the rigid elements 38*a,* 38*b,* 38*c,* 38*d,* are beneficially composed of an aluminum metal, or of a composite material. It should also be noted that one could have only 3 elements or more than 4 elements without going outside the scope of the invention. Thus, as indicated, for example, in the variation illustrated in FIGS. 11*a* and 11*b,* the large-scale cupola 38 is made up of a large number of rigid elements in the shape of small-size cupola sections articulated by a sliding ring and counter-stays assembly. Of course, in said embodiment, the heating device 1 is comprised of a central support pole 3 supporting at its upper extremity 3*a,* a heating element 8 surmounted by the cupola 38, and, perhaps, a reflecting cupola 7.

According to several variations illustrated in FIGS. 12*a* to 15, and whereas the earlier described parts carry the same references for better clarity, the terrace heating device includes a supporting means where the support pole 3 is not centrally arranged, but is placed in a manner so as to be located outside of space 5, in plumb alignment with the heating means 8 and the large-scale cupola, when the device is in an open position. Because of that, the terrace heating device 1 presents to the user a heating area located below its insulation means, which is free of a central support pole, and its base being located outside the heating area. Thus, according to a first variation, the support means includes a base equipped with an enclosure intended to receive the supply means 4 such as a bottle of gas, as well as, the different types of spare fabric(s). A support pole 25 mounted in articulated fashion on the support base, a radial beam 26 intended to support at its opposite end a secondary central support pole 27, for supporting the fabric, the actuating and positioning means, the heating means, and the reflecting cupola. It should be noted that, according to this variation, the actuating and positioning means can be achieved in several different ways of the kind known per se. It should also be noted that, according to said variation, the distance between the support and secondary poles can be regulated by positioning means which act, for example, on the radial beam, or on the articulation between the beam and the support pole.

Figure 13A:
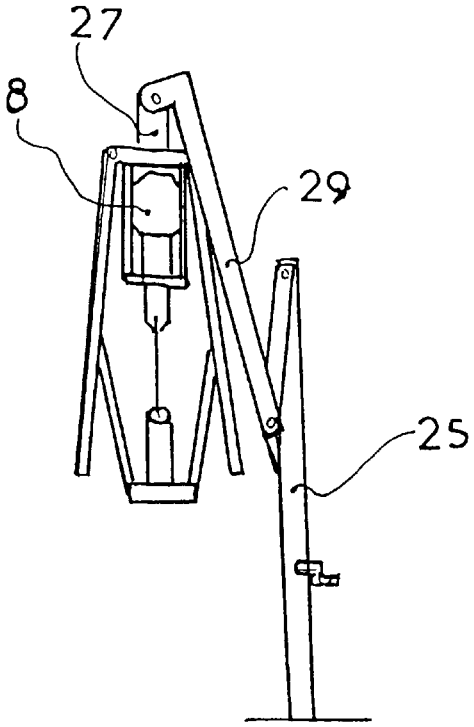
FIGS. 13*a* and 13*b* respectively represent a variation in views similar to FIGS. 8*a* and 8*b*.
Figure 13B:
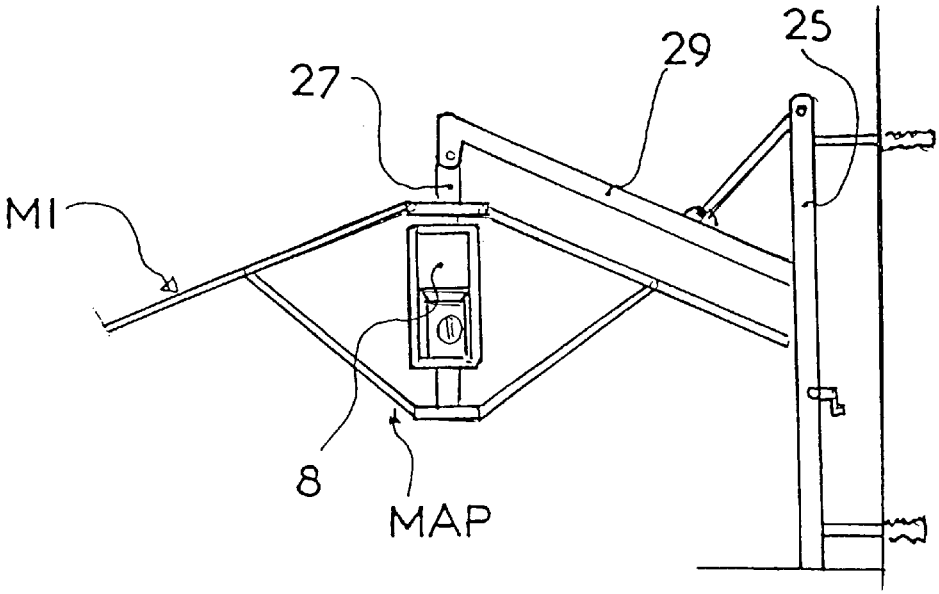
Figure 14A:
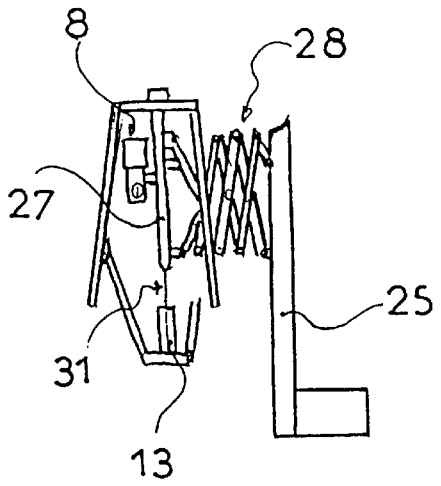
FIGS. 14*a* and 14*b* respectively represent a second specific embodiment in views similar to FIGS. 8*a* and 8*b*.
Figure 14B:
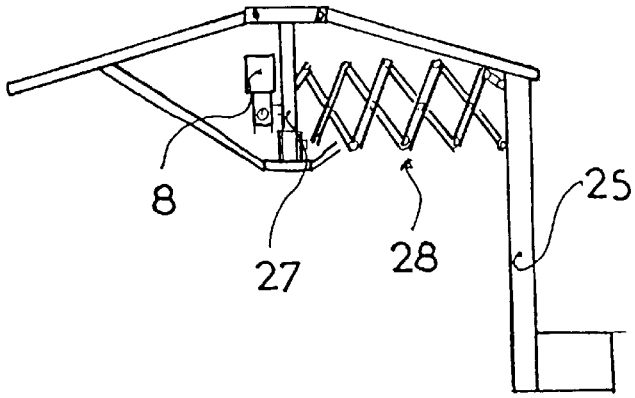

According to this variation, and two other variations illustrated in FIGS. 13*a,* 13*b,* 14*a,* and 14*b,* demonstrating various articulation possibilities between the secondary central pole 27 and the support pole 25, such as an articulated lattice-work 28, or a radial beam system 29 mounted in pivoting fashion, the actuating and positioning means MAP can beneficially be automatically regulated with the control device of the support and secondary poles. Thus, the actuating and positioning means MAP are simultaneously activated by the deployment of the articulation system between the secondary pole and the central pole, due to a flexible attachment system 31 connecting a fixed point of the support pole to a sliding ring 11.

When the device is deployed, the user has access to the ignition means of the heating element, said heating element forming one solid unit with the secondary pole and connects with the supply means by a flexible hose 32.

Figure 15:
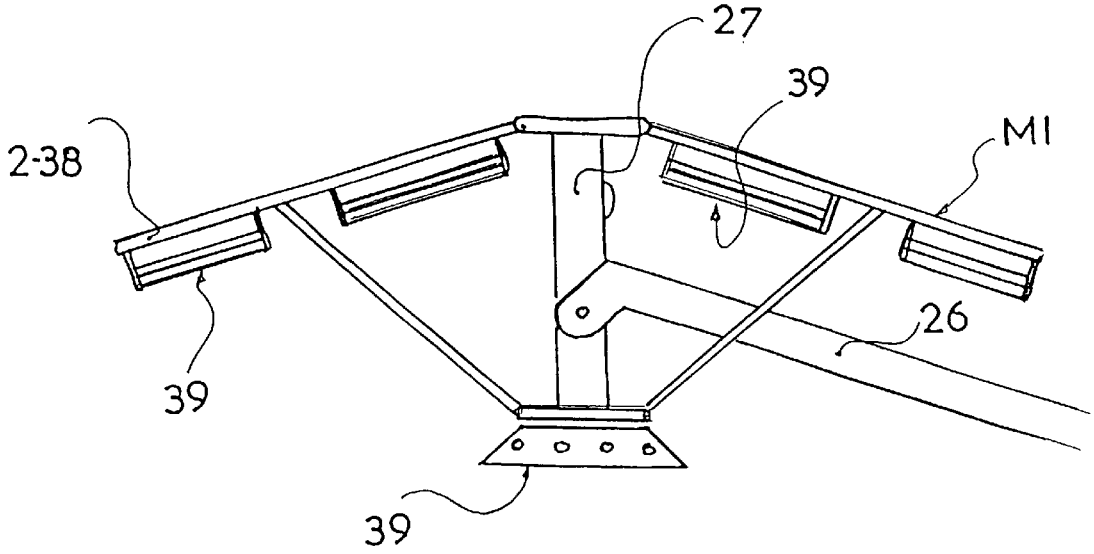

It should also be noted that the heating means MC can include several halogen-type heating elements 39, arranged under the large-scale cupola 38, or the fabric 2, and/or on the lower end of the secondary pole, as indicated, for example, in FIG. 15.

In addition, it should be noted that in the specific embodiments comprising of a fabric, or of several cupola parts, the articulation of said cupola parts can be effected by an actuator, independent from the actuator of the fabric and they are not necessarily acted upon by the same actuator.

Obviously, the invention is not limited to the realization modes described and represented by way of example, but it includes as well all equivalent techniques, as well as their combinations.

What is claimed is:

1. A Terrace Heating Device comprising:

at least one heating element;

a support pole on which the heating element is supported;

a reflector disposed above the heater to reflect heat generated by the heating element;

an insulation means which is disposed above the heater and articulable between two positions, an open deployed position corresponding to a position of utilization, and a closed position corresponding to a position of storage.

2. The Terrace Heating Device according to claim 1, characterized in that the insulation means forms a large-scale cupola arranged in the open position in a general horizontal plane, situated above the heating element.

3. The Terrace Heating Device according to claim 2, characterized in that the large-scale cupola is made of a fabric.

4. The Terrace Heating Device according to claim 2, characterized in that the cupola is composed of a plurality of rigid or semi-rigid elements.

5. The Terrace Heating Device according to claim 2, characterized in that the large-scale cupola is unfolded to an open deployed position and folded to a closed position via an actuating and positioning means.

6. The Terrace Heating Device according to claim 1, characterized in that the reflector is insulated.

7. A Terrace Heating Device comprising:

at least one heating element;

a support pole on which the heating element is supported;

a cupola constructed of insulation material, the cupola including a plurality of rigid or semi-rigid elements, each of the elements of the cupola being in the shape of a cupola section, each being articulated on one of the support pole and a complementary support piece forming an integral part of the support pole and being articulable between two positions, an open deployed position above the heating element corresponding to a position of utilization, and a closed position corresponding to a position of storage.

8. A Terrace Heating Device including:

a heater;

an insulating cupola which traps heat thereunder;

at least one heat shield disposed between the heater and the cupola;

the insulating cupola and the heat shield both being articulated for movement between folded positions and open positions.

9. A Terrace Heating Device comprising:

a large-scale cupola constituted of insulation material, the cupola being articulable between two positions, an open deployed position corresponding to a position of utilization, and a closed position corresponding to a position of storage;

at least one heating element mounted under the cupola;

a support pole on which the cupola is supported, the support pole being displaced in such manner so as to be located outside a perimeter of the large-scale cupola in the open deployed position, while being arranged in plumb alignment with the heating element and the insulation material.

10. A terrace heating device comprising:

a base;

a pole extending upward from the base;

a heater supported on the pole;

a flexible panel supported on the pole by articulated ribs for movement between an open position in which heat is trapped thereunder and a closed, storage position; and, a reflector disposed closely adjacent and above the heater at least in the open position for reflecting rising heat from the heater downward.

11. A method of heating a terrace comprising:

positioning a heater above patrons on the terrace;

deploying an articulated large-scale umbrella cover above and over the patrons;

starting the heater;

reflecting heat from the heater downward toward the patrons via with a reflector; and holding hot-air rising from the patrons and associated structures close to the patrons, with the large-scale umbrella cover.

* * * * *